US009239156B2

(12) United States Patent
Wang et al.

(10) Patent No.: US 9,239,156 B2
(45) Date of Patent: Jan. 19, 2016

(54) STRUCTURES FOR LED LIGHT BULBS

(71) Applicant: CLEDOS green tech Limited, Hong Kong (HK)

(72) Inventors: James Wang, Hong Kong (HK); Kei May Lau, Hong Kong (HK); Parco Wang, Hong Kong (HK); Wei Xiong Liao, Hong Kong (HK); Terence Cho, Hong Kong (HK); Zhaojun Liu, Hong Kong (HK); Eddie Chong, Hong Kong (HK)

(73) Assignee: CLEDOS GREEN TECH LIMITED, Hong Kong (HK)

( * ) Notice: Subject to any disclaimer, the term of this patent is extended or adjusted under 35 U.S.C. 154(b) by 0 days.

(21) Appl. No.: 13/970,224

(22) Filed: Aug. 19, 2013

(65) Prior Publication Data

US 2014/0177279 A1 Jun. 26, 2014

(51) Int. Cl.

| | |
|---|---|
| ***H01R 33/00*** | (2006.01) |
| ***F21V 23/00*** | (2015.01) |
| ***F21K 99/00*** | (2010.01) |
| *F21Y 101/02* | (2006.01) |

(52) U.S. Cl.

CPC ..... *F21V 23/004* (2013.01); *F21K 9/135* (2013.01); *F21Y 2101/02* (2013.01)

(58) Field of Classification Search

CPC ..... F21V 23/004; H05K 2201/09; H05K 2203/06; H05K 2201/10; H05K 2201/06; H05K 1/00

USPC ..... 362/646, 382, 218, 219, 222, 217, 362/249.01, 249.06, 311.04, 311.06, 370

See application file for complete search history.

(56) References Cited

U.S. PATENT DOCUMENTS

| | | | | |
|---|---|---|---|---|
| 5,241,238 | A * | 8/1993 | Westlund et al. | 313/25 |
| 2009/0302730 | A1* | 12/2009 | Carroll et al. | 313/46 |
| 2011/0227471 | A1* | 9/2011 | Richard et al. | 313/113 |
| 2012/0032577 | A1* | 2/2012 | Huang | 313/318.01 |
| 2012/0236602 | A1* | 9/2012 | Flaherty et al. | 362/650 |
| 2012/0262054 | A1* | 10/2012 | Ooyabu et al. | 313/498 |

* cited by examiner

*Primary Examiner* — Diane Lee
*Assistant Examiner* — Omar Rojas Cadima
(74) *Attorney, Agent, or Firm* — Venture Pacific Law, PC

(57) ABSTRACT

Structures for LED light bulbs comprise a driver board and a lighting structure having one or more LEDs disposed thereon. The driver board, in a Y shape, can be the circuit board and has a positive terminal and a negative terminal for receiving electrical power. The Y-shaped driver board having two prongs connects to the light structure to power the LEDs thereon. The lighting structure can be in the form of a grid having the LEDs disposed thereon.

12 Claims, 19 Drawing Sheets

STRUCTURES FOR LED LIGHT BULBS

PRIORITY CLAIM

This application claims priority from the following: (i) a Chinese patent application entitled "Simple LED Light Bulbs Without Heat Sink" filed on Dec. 24, 2012 and having a Chinese Application No. 201230648078.6; (ii) a Chinese patent application entitled "Round LED Light Bulbs Without Heat Sink" filed on Dec. 24, 2012 and having a Chinese Application No. 201230648076.7; (iii) a Chinese patent application entitled "Flood Light-Type LED Light Bulbs Without Heat Sink" filed on Dec. 24, 2012 and having a Chinese Application No. 201230648096.4; (iv) a Chinese patent application entitled "Track Light Type LED Light Bulbs Without Heat Sink" filed on Dec. 24, 2012 and having a Chinese Application No. 201230648080.3; (v) a Chinese patent application entitled "Lead Frame For LED Light Bulbs Without Heat Sink" filed on Dec. 24, 2012 and having a Chinese Application No. 201230648077.1; and (vi) a Chinese patent application entitled "Round LED Light Bulbs Without Heat Sink" filed on Apr. 10, 2013 and having a Chinese Application No. 201330105889.6.

FIELD OF INVENTION

The present invention generally relates to structures for LED light bulbs, and, more particularly, to structures for LED light bulb that are conducive to heat dissipation.

BACKGROUND

LED light bulbs are generally comprised of one or more LED dies configured on a circuit board and the circuit board is then placed in a light bulb. The light bulb can then be secured into a light bulb socket or a lighting fixture. Prior art LED light bulbs are typically large in size with many design elements (e.g. copper fins or aluminum fins) providing for the dissipation of heat. While these design elements are essential for heat dissipation, they increase manufacturing cost of the light bulb as well as the weight of the light bulb (thereby increasing their shipping cost). This is a problem for LED light bulbs designed to replace traditional incandescent light bulbs because many LED dies (or a few large LED dies) would be needed to generate sufficient amount of luminance to replace the traditional incandescent light bulb. But in operation, these LED dies would generate a tremendous amount of heat, and if the amount of heat is not properly managed, the light bulb could malfunction or become a fire hazard. It is therefore desirable to have a structure for LED light bulbs that would be efficient in heat dissipation and would have a low manufacturing cost.

SUMMARY OF THE INVENTION

An object of the present invention is to provide a LED light bulb conducive to heat dissipation.

Another object of the present invention is to provide a lighting structure that has low manufacturing cost.

Briefly, a LED light bulb having a lighting structure that comprises: one or more first struts substantially disposed in a first direction; and one or more second struts substantially disposed in a second direction, wherein certain ones of the first struts and certain ones of the second struts intersects; wherein one or more LED dies are placed on the struts; and wherein a conductive area of the lighting structure provides one or more electrical pathways for powering the LED dies, and one or more dissipation areas of the lighting structure provide for heat dissipation.

An advantage of the present invention is that it provides for a LED light bulb that is conducive to heat dissipation.

Another advantage of the present invention is that it provides a lighting structure that has low manufacturing cost.

DESCRIPTION OF THE DRAWINGS

The foregoing and other objects, aspects, and advantages of the invention can be better understood from the following detailed description of the preferred embodiment of the invention when taken in conjunction with the accompanying drawings in which.

DETAILED DESCRIPTION OF THE PREFERRED EMBODIMENTS

In the following detailed description of the embodiments, reference is made to the accompanying drawings, which form a part hereof, and in which is shown by way of illustration of specific embodiments in which the present invention may be practiced.

Figure 1A:
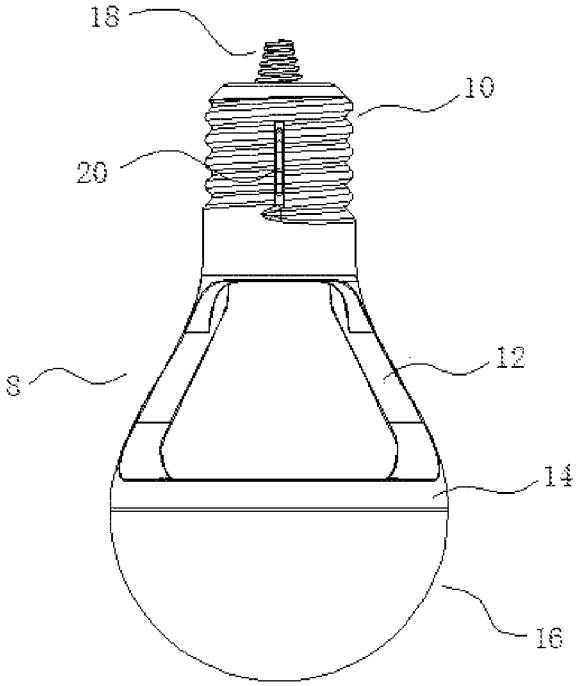
FIG. 1*a* illustrates a view of an embodiment of a light bulb of the present invention.
Figure 1B:
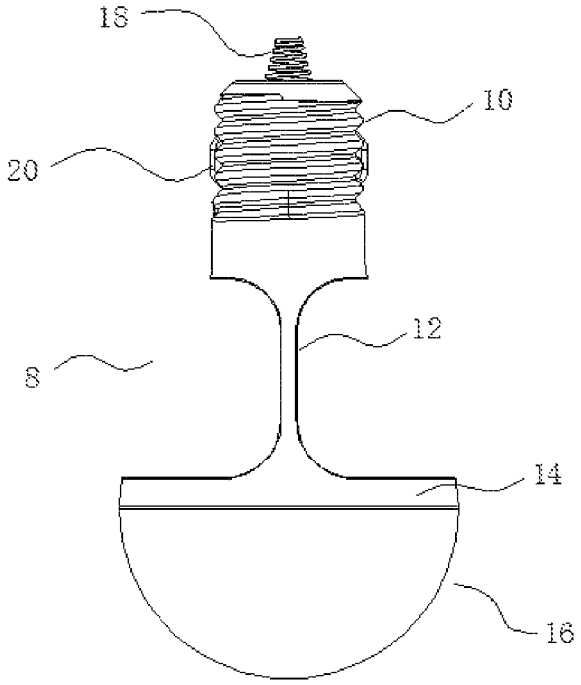
FIG. 1*b* illustrates a side view of an embodiment of a light bulb of the present invention showing in one respect that the driver bracket is a flat piece.
Figure 1C:
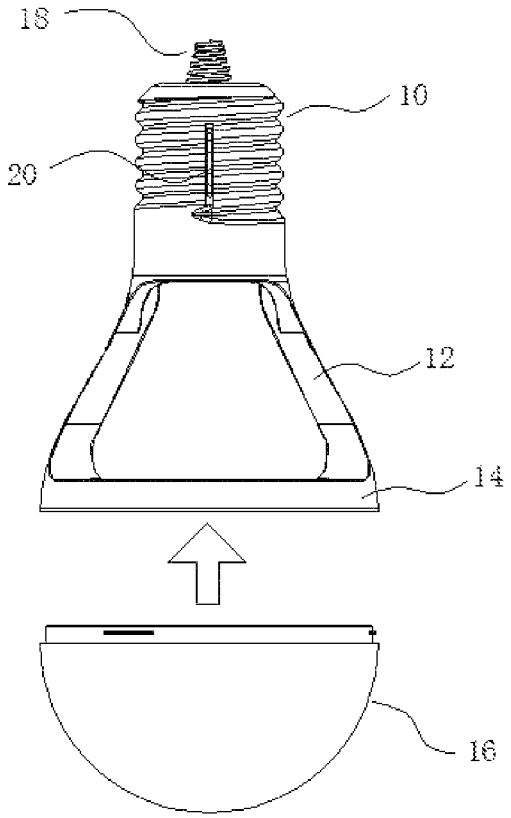
FIG. 1*c* illustrates a view of an embodiment of a light bulb of the present invention where the dome is attachable and detachable.

Referring to FIG. 1*a*, a preferred embodiment of the present invention in the form of a light bulb 8 is illustrated, comprising of a screw head 10, a driver bracket 12, a lighting bracket 14, a dome 16 and a first contact 18 and a second contact 20. The first contact 18 and the second contact 20 are for receiving power from a power source. The screw head 10 is provided to be insertable into traditional light bulb sockets. In this embodiment, the screw head 10, the driver bracket 12, and the lighting bracket 14, along with the dome 16 form the light bulb 8. Referring to FIG. 1*b*, a side view of the preferred embodiment of the present invention is presented where the driver bracket 12 is shown here as a flat piece holding the lighting bracket 14. Referring to FIG. 1*c*, the dome 16 can be a simple snap on piece to the lighting bracket 14.

Figure 2A:
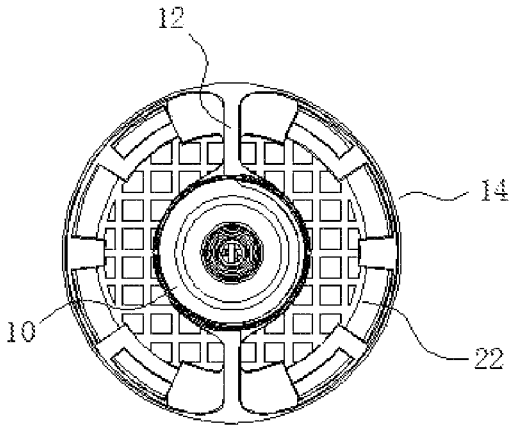
FIG. 2*a* illustrates a top view of an embodiment of a light bulb of the present invention, showing the socket, the driver bracket, the lighting bracket, and the lighting structure.
Figure 2B:
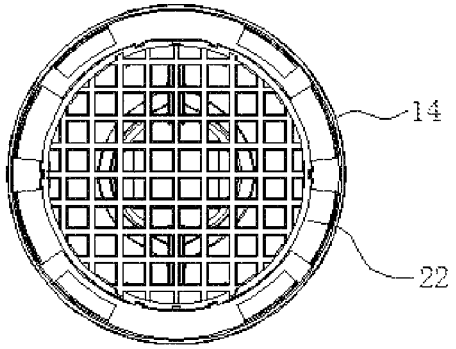
FIG. 2*b* illustrates a bottom view of an embodiment of a light bulb of the present invention, showing the lighting structure, the lighting bracket, among other aspects.

FIG. 2*a* illustrates a top view of the preferred embodiment of the present invention in the form of a light bulb where the screw head 10 holds the driver bracket 12 and the driver bracket 12 holds the lighting bracket 14, and the lighting bracket 14 holds a lighting structure 22 in place. FIG. 2*b* illustrates a bottom view (looking from the bottom toward the top) of the light bulb. Here, it is shown that the lighting bracket 14 holds the lighting structure 22 in place, and the light structure 22 is in the form of a plurality of struts in a first direction and a plurality of intersecting struts in a second direction substantially forming a grid.

Note that a number of LED dies can be placed on the lighting structure, for example, at the intersecting points of the struts forming the grid (or thereabout). The number of LED dies disposed on the light structure would correspond to the desired luminance for the light bulb. The spacing between the struts can be designed and calculated as a function of (i) the amount of heat generated by each LED die, and (ii) the desired amount of heat dissipation in respect of the surrounding LED dies. Other considerations such as the melting point of the surrounding material or the maximum desired temperature can also be taken into consideration (among other considerations).

The spacing between the LED dies and the size of the openings created by the struts will determine whether heat can be properly dissipated. This is an important consideration since improper spacing and/or opening size can result in undesirable high concentration of heat which can become a safety hazard. If the number of LED dies that can be safely placed on the light structure exceeds the size of the lighting structure, the additional LED dies can be placed in other manners. For example, the additional LED dies can be placed on a second lighting structure that is secured either above or below the first lighting structure. Here, the opening of the lower lighting structure can be designed to allow for the maximum amount of light to shine through from the LED dies of the upper lighting structure; and the LED dies can be evenly distributed on both the upper and the lower lighting structures. Another example for the placement of additional LED dies is to have a single lighting structure but to have posts (of desired heights) extending perpendicular from the lighting structure; and the additional LED dies can be placed on the posts.

Note that although the lighting structure is shown as a grid having substantially square-shaped spacing, other configurations for the lighting structure 22 are possible. The lighting structure 22 can have a grid in diamond shapes, in circular or elliptical shapes, and in single lines of struts, or other desirable configurations as well. For example, the entire lighting structure can be a single line of strut having one or more LEDs disposed thereon; and the two ends of the strut would connect to the driver board (described below).

Figure 2C:
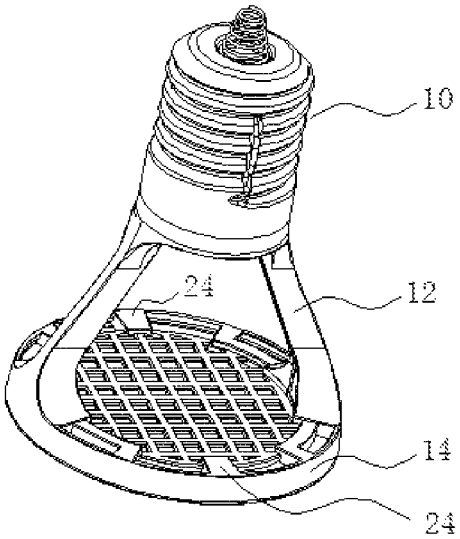
FIG. 2*c* illustrates an angled view of an embodiment of a light bulb of the present invention, showing the socket, the driver bracket, the lighting bracket, and the lighting structure.

FIG. 2*c* illustrates an angled view of the light bulb of the preferred embodiment of the present invention. Here, the screw head 10 assembled with the driver bracket 12, and the driver bracket 12 holds the lighting bracket 14 with its extended arms. The lighting bracket 14 in turn holds the lighting structure 22 with several support notches 24. It is important to note that the simplicity of this structure significantly reduces manufacturing cost, weight of the light bulb, and it maximizes heat dissipation.

Figure 3A:
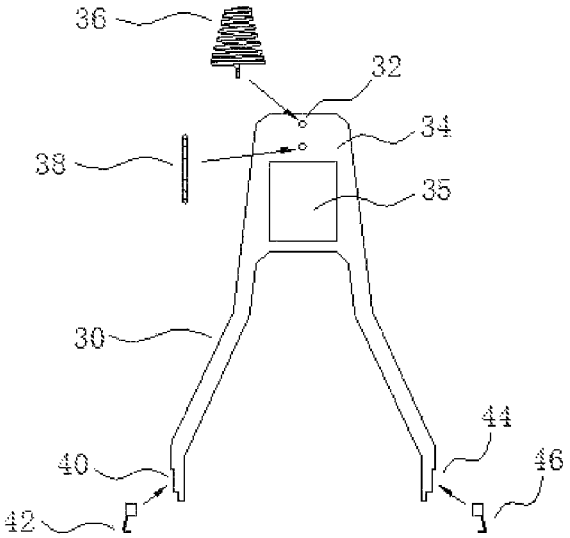
FIGS. 3*a*-3*c* illustrate an assembly of the driver circuit board of the present invention with the conductive spring and the conductive hook.
Figure 3B:
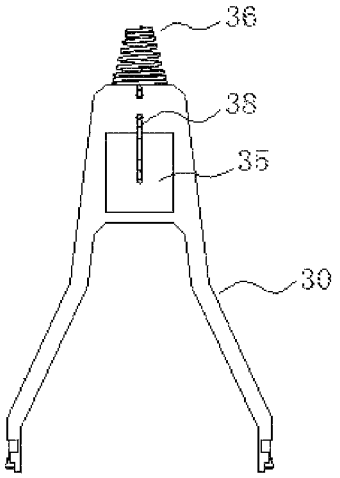
Figure 3C:
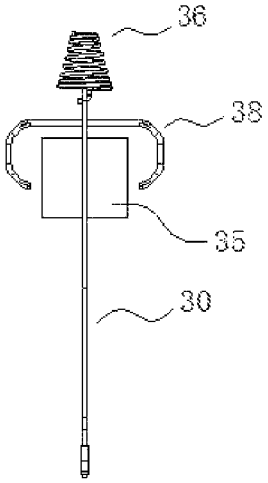

FIG. 3*a* illustrates a driver board 30, which can be a simple piece of board. Here, it is generally in a Y shape. For the preferred embodiment, the driver board 30 is also a circuit board as well. The driver circuit board 30 has a number of contact points, including a contact point at 32 for accepting the conductive spring 36 and a contact point at 34 for accepting the conductive hook 38. There is also a power converter 35 for converting the received power to the proper voltage needed for the LED dies. The driver circuit board 30 has a first conductive interface 40 for conducting the circuits on the driver circuit board 30 and the lighting structure 22 and a first clip 42 for securing the driver circuit board 30 with the lighting structure 22. Likewise, it has a second conductive interface 44 for conducting the circuits on driver circuit board 30 and the lighting structure 22 and a second clip 46 for securing the driver circuit board 30 with the lighting structure 22. The first conductive interface 40 can be the positive terminal and the second conductive interface 44 can be the negative terminal. In this manner, the control circuitry on the driver circuit board 30 controls and powers the LED dies on the lighting structure 22. FIG. 3*b* illustrates an assembled embodiment of the driver circuit board 30 where the conductive spring 36 is attached at contact point 32 and the conductive hook 38 is attached at contact point 34. FIG. 3*c* illustrates a side view of the driver circuit board 30 with the conductive spring 36 and conductive hook 38 attached to the board 30. In the manner, the LED dies are electrically connected to the driver circuit board and can be operated by the circuits on the driver circuit board.

In alternative embodiments, the driver board can be designed to have one or more prongs. While FIGS. 3*a*-3*c* illustrated a two prong driver board, a single prong driver board can be designed to hold the lighting structure in place. For example, a single prong driver board can be designed to be secured to the lighting structure at a single point (e.g. at the center of the lighting structure) and thus holding the lighting structure in place.

Figure 4B:
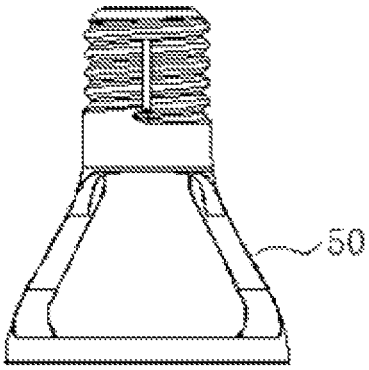
FIGS. 4*a*-4*c* illustrate the insertion of the driver circuit board into the holder of the present invention.
Figure 4C:
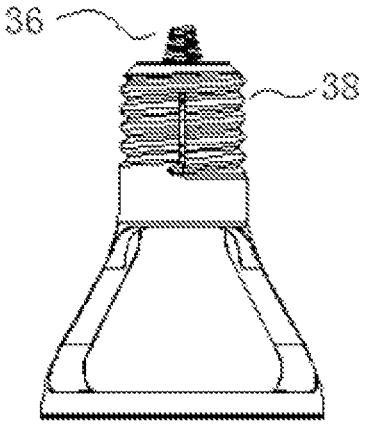
Figure 4A:
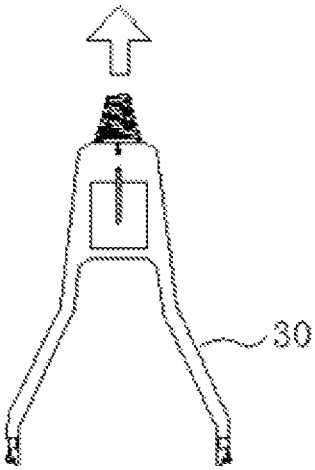
Figures 4D, 4E, 4F:
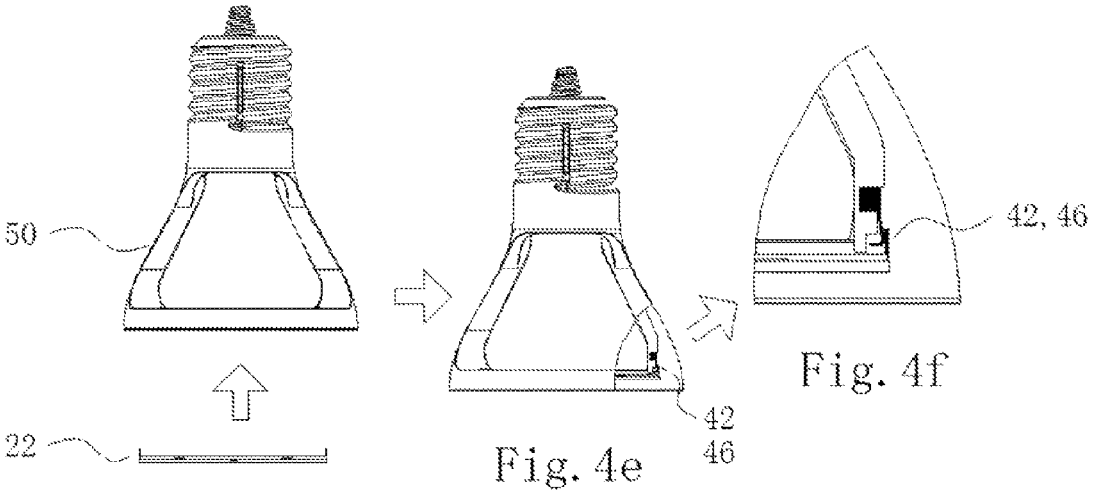
FIGS. 4*d*-4*f* illustrate the attachment of the lighting structure to the driver circuit board.

Once the driver circuit board 30 is assembled, referring to FIG. 4*a*, it can be inserted into the holder 50 (comprising of the screw head 10, the driver bracket 12, and the lighting bracket 12) (see FIG. 4*b*), and FIG. 4*c* illustrates the post-assembled light bulb where the driver circuit board 30 is inserted into the holder 50 and the conductive spring 36 and the conductive hook 38 are in place in the holder. After the driver circuit board 30 is inserted into the holder 50, referring to FIG. 4*d*, the lighting structure 22 can be snapped into place with the driver circuit board 30 using the clips 42 and 46 (as shown in FIGS. 4*e* and 4*f*).

Referring to FIGS. 5*a*-5*e*, the steps in manufacturing the lighting structure 22 are illustrated. In manufacturing the lighting structure, referring to FIG. 5*a*, a preferred method is to start with a stamped cooper frame 60, and the cooper frame 60 may be designed such that there may be one or more conducting areas 62 for conducting electricity and/or signals and there may be one or more dissipation areas 70, 72 for the dissipation of heat. The conducting area(s) are not conductive with the dissipation area(s). The cooper frame 60 can be initially held by breakaway holders 80, 82, 84, and 86.

Referring to FIGS. 5*a*-5*e*, the steps in manufacturing the lighting structure 22 are illustrated. In manufacturing the lighting structure, referring to FIG. 5*a*, a preferred method is to start with a stamped copper frame 60, and the copper frame 60 may be designed such that there may be one or more conducting areas 62 for conducting electricity and/or signals and there may be one or more dissipation areas 70, 72 for the dissipation of heat. The conducting area(s) are not conductive with the dissipation area(s). The copper frame 60 can be initially held by breakaway holders 80, 82, 84, and 86.

Figure 5A:
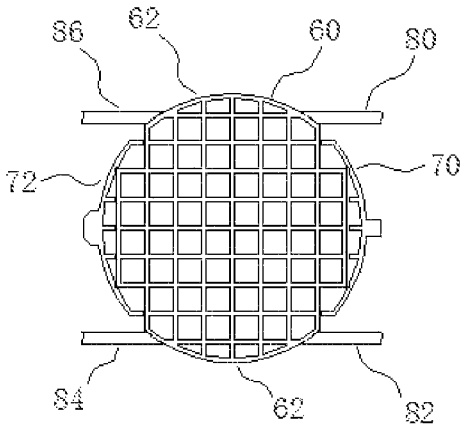
FIG. 5*a* shows a stamped copper frame for the lighting structure of the present invention.

The design of conducting areas and the design of the dissipation areas may depend on the number LED dies to be placed on the lighting structure and the configuration of the LED dies on the lighting structure. For example, as illustrated by FIG. 5*a*, this copper frame 60 is designed to have one main conducting area 62 because there will be many LED dies substantially placed all over on the conducting area 62 (see FIG. 6 for the placement of the LED dies for this particular configuration). For this particular configuration, there are two dissipation areas, 70 and 72, for the dissipation of heat, where these dissipation areas, 70 and 72, are not electrically connected to the conducting area 62. If the number of dies being placed on the copper frame 60 changes, the size(s) of the conducting area(s) and the size(s) of the dissipation area(s) can be configured accordingly.

Figure 5B:
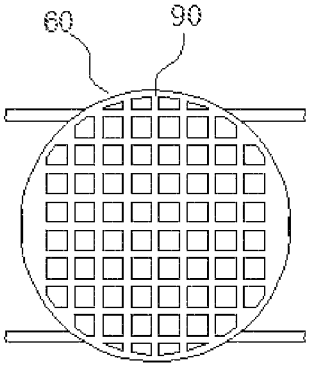
FIG. 5*b* shows a stamped copper frame encapsulated in a plastic package.

Referring to FIG. 5*b*, after the copper frame 60 is stamped, a packaging material (e.g. plastic packaging) can be applied over the copper frame. FIG. 5*b* illustrates one side of the lighting structure 22 in which the copper frame 60 is covered by a plastic packaging. Please note that although the plastic packaging 90 is shown to substantially cover the entire copper frame 60, the amount of coverage can be designed as desired to offer desired structure support as well as heat dissipation. The positive and negative terminals of the lighting structure can also be marked accordingly.

Figure 5C:
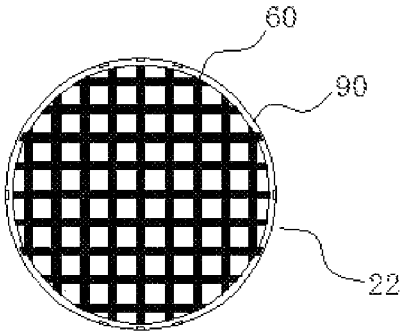
FIG. 5*c* shows another embodiment of the encapsulated copper frame of the present invention.

FIG. 5*c* shows that after the encapsulation of the copper frame 60, a reflective substance can be placed on the plastic packaging to help reflecting the light.

Figure 6:
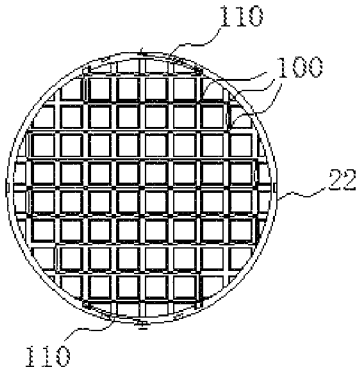
FIG. 6 illustrates one placement of LED dies on the lighting structure where such LED dies are connected view a wire to positive and negative terminals.

FIG. 6 illustrates one placement of LED dies 100 on the lighting structure 22 where the LED dies 100 are electrically connected via a wire 110 that, in this particular configuration, connects all the LED dies in a planned path on the lighting structure 22. There are many configurations possible here, depending on the number of LED dies. The LED dies can also be connected serially or in parallel.

Figure 7A:
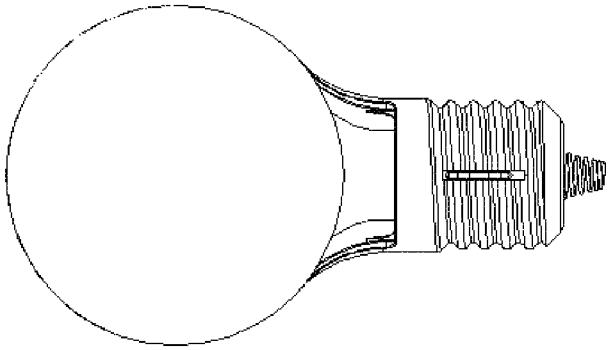
FIGS. 7*a*-7*e* illustrate another embodiment of a light bulb of the present invention where the direction of the light is at an angle.
Figure 7B:
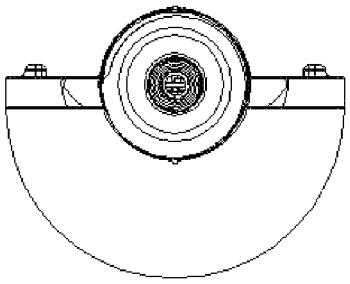
Figure 7C:
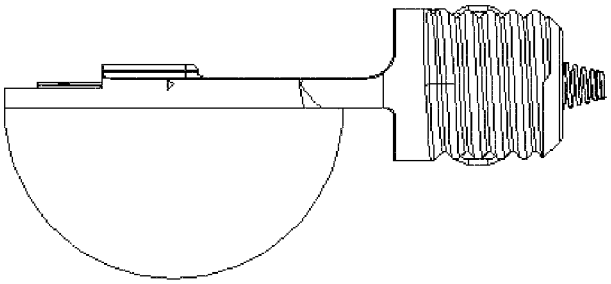
Figure 7D:
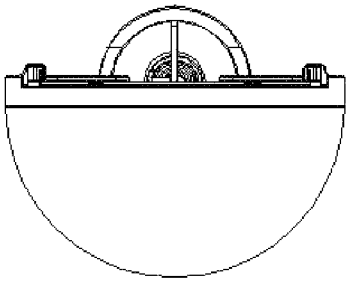
Figure 7E:
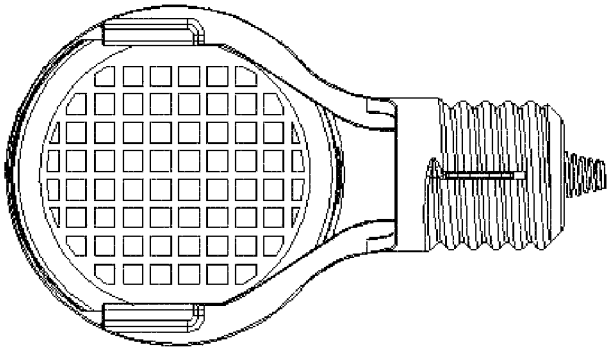

FIGS. 7*a*-7*e* illustrate another embodiment of the light bulb of the present invention. Here, the direction of the light and the light bulb itself are at an angle. FIG. 7*a* illustrates a view from the bottom of the light bulb, FIG. 7*b* illustrates a view from the screw-end, FIG. 7*c* illustrates a side view, FIG. 7*d* illustrates a front view, and FIG. 7*e* illustrates a top view. Other than the orientation between the direction of the light and the light bulb itself, the designs and operation of the light bulb can be substantially similar to the description provided above.

Figure 8:
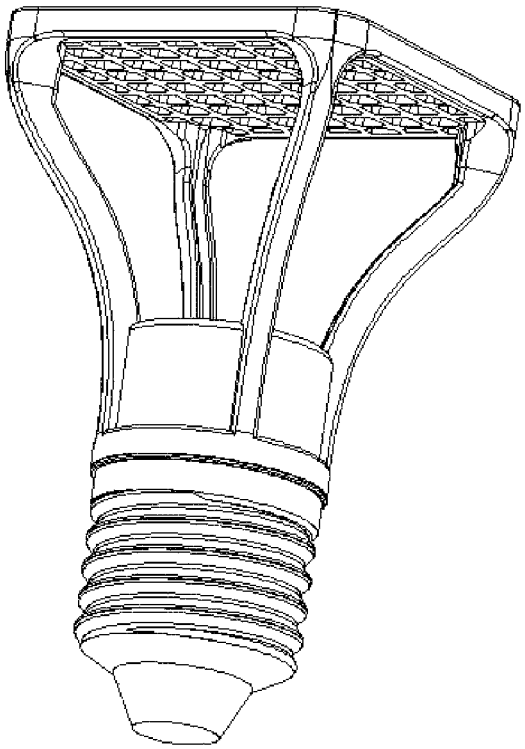
FIG. 8 illustrates an alternate embodiment of a light bulb where the light structure (grid) is held by a four prong holder.
Figure 9:
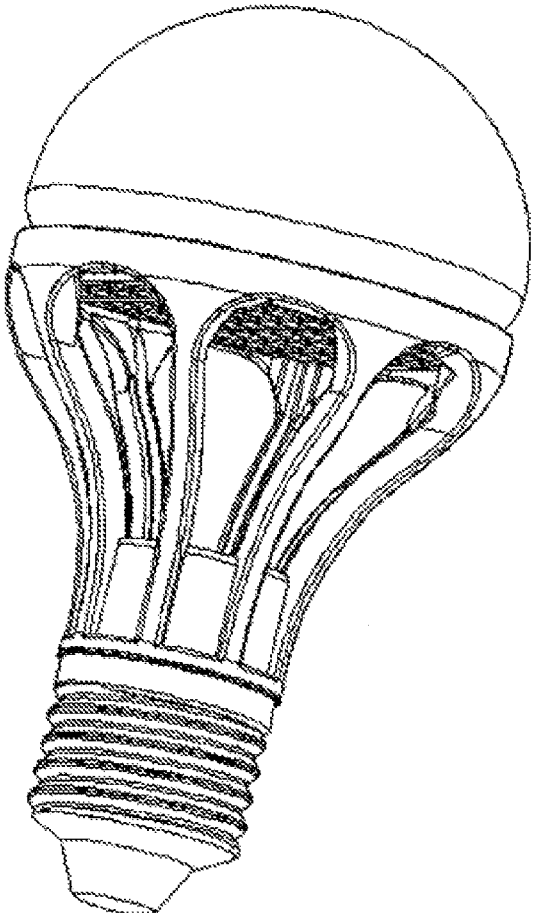
FIG. 9 illustrates yet another embodiment of a light bulb in where the lighting structure (grid) is circular in shape and is held by several prongs.
Figure 10:
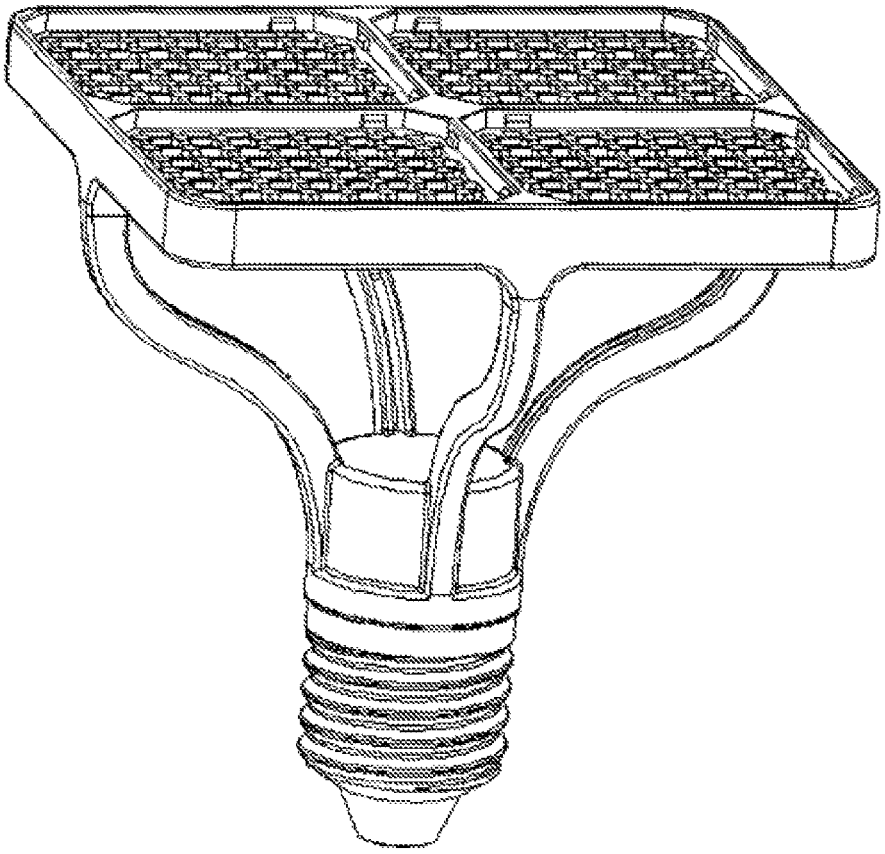
FIG. 10 illustrates still yet another embodiment of a light bulb where the lighting structure (grid) is substantially rectangular in shape.
Figure 11:
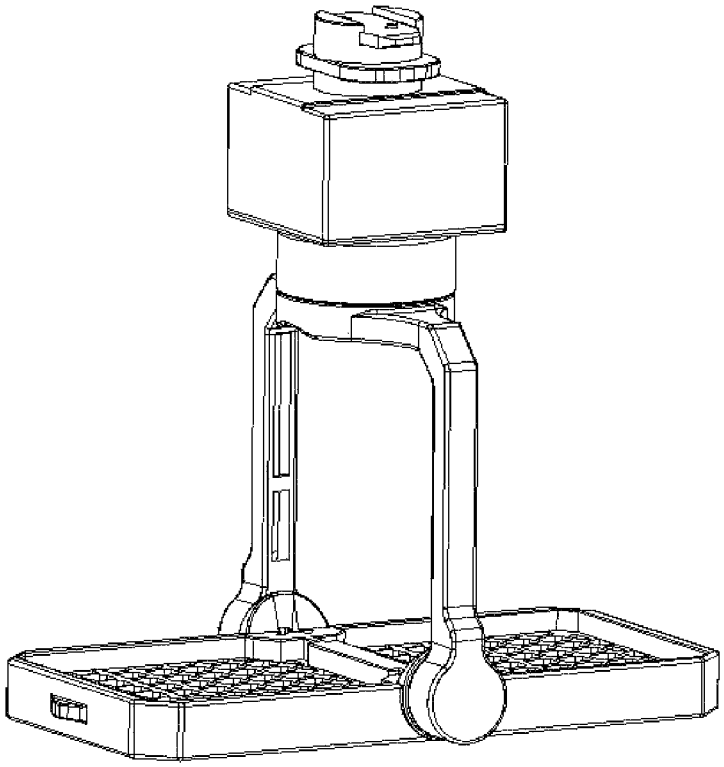
FIG. 11 illustrates still yet another embodiment of a light bulb where the lighting structure (grid) is substantially rectangular in shape and is held in place by two side prongs.
Figure 12:
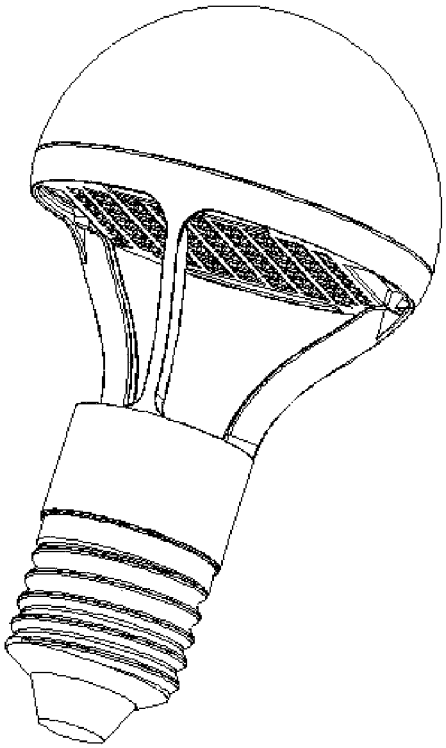
FIG. 12 illustrates still yet another embodiment of a light bulb where the lighting structure (grid) is substantially circular in shape with a half dome.

FIG. 8 illustrates an alternate embodiment of a light bulb where the light structure (grid) is held by a four prong holder and the lighting structure grid is substantially square in shape. FIG. 9 illustrates yet another embodiment of a light bulb in where the lighting structure (grid) is circular in shape and is held by several prongs. FIG. 10 illustrates still yet another embodiment of a light bulb where the lighting structure (grid) is substantially rectangular in shape and is held in place by four prongs with one prong on each side. FIG. 11 illustrates still yet another embodiment of a light bulb where the lighting structure (grid) is substantially rectangular in shape and is held in place by two side prongs where the grid can rotate to direct the light. FIG. 12 illustrates still yet another embodiment of a light bulb where the lighting structure (grid) is substantially circular in shape with a half dome and the lighting structure is held in place by three prongs.

Figure 13A:
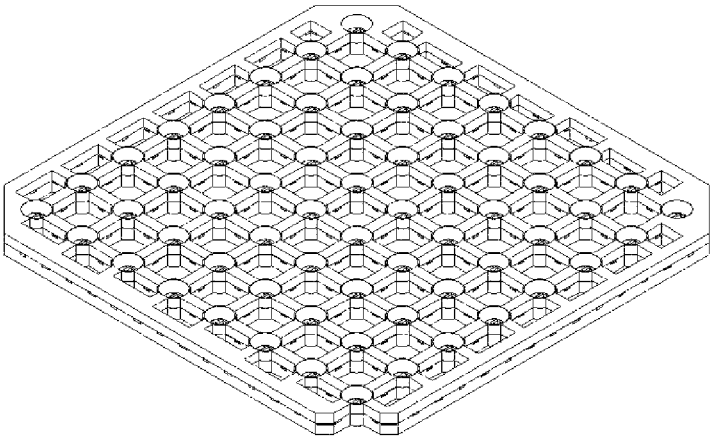
FIG. 13*a* illustrates another embodiment of the lighting structure that is substantially square in shape.
Figure 13B:
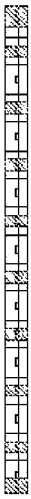
FIG. 13*b* illustrates a cross section of the lighting structure showing the copper frame being sandwiched between the plastic packaging.

FIG. 13*a* illustrates another embodiment of the lighting structure that is substantially square in shape. FIG. 13*b* illustrates a cross section of the lighting structure showing the copper frame being sandwiched between the plastic packaging material.

While the present invention has been described with reference to certain preferred embodiments or methods, it is to be understood that the present invention is not limited to such specific embodiments or methods. Rather, it is the inventor's contention that the invention be understood and construed in its broadest meaning as reflected by the following claims. Thus, these claims are to be understood as incorporating not only the preferred methods described herein but all those other and further alterations and modifications as would be apparent to those of ordinary skilled in the art.

We claim:

1. A LED light bulb, comprising:

a driver board; and a lighting structure comprises a frame, wherein the lighting structure has one or more LEDs disposed thereon and wherein the frame has one or more conducting areas for conducting electricity to the LEDs and one or more dissipation areas for dissipating heat from the LEDs;

wherein the light structure is a grid structure having struts, wherein the one or more conducting areas and the one or more dissipation areas are connected together to form the grid structure, wherein the struts are spaced to form openings in the grid structure, wherein the openings between the struts are determined as a function of an amount of desired heat dissipation for the one or more LEDs, wherein the openings allow for gas flow from outside of the LED light bulb to enter the grid structure to cool the LEDs, and wherein the driver board having a positive terminal and a negative terminal for receiving electrical power, and the driver board connects to the lighting structure to power the LEDs thereon; and, wherein the lighting structure has:

certain ones of the struts are disposed in a first direction; and other ones of the struts are disposed in a second direction, wherein the certain ones of the struts intersect the other ones of the struts, wherein one or more LEDs are disposed at the intersections of the certain ones of the struts and the other ones of the struts; and, wherein the driver board is inserted into a holder for holding the driver board and the lighting structure; and, wherein the holder has a screw shape on one end for fitting into a light bulb socket.

2. The LED light bulb of claim 1 wherein the driver board is also a circuit board.

3. The LED light bulb of claim 1 wherein the driver board is in a Y shape.

4. The LED light bulb of claim 3 wherein the Y shape of the driver board has two prongs for connecting to the lighting structure.

5. The LED light bulb of claim 1 wherein the frame is a copper frame encapsulated in a selected packaging type, wherein the copper frame is rigid, wherein the dissipation areas are not electrically connected to the conducting areas, and wherein a reflective substance is disposed on the selected packaging type to reflect light from the LEDs.

6. A LED light bulb, comprising:

a driver board having a plurality of contact points to connect the driver board to a power source;

a conductive spring, wherein a first one of the contact points is coupled to the conductive spring;

a conductive hook, wherein a second one of the contact points is coupled to the conductive hook;

a lighting structure comprises a copper frame, wherein the lighting structure has one or more LEDs disposed thereon, wherein the lighting structure has a first side and a second side and wherein the LEDs are disposed on the first side of the lighting structure, wherein the copper frame has one or more conducting areas for conducting electricity to the LEDs and one or more dissipation areas for dissipating heat from the LEDs, and wherein the dissipation areas are not electrically connected to the conducting areas; and a cover, wherein the lighting structure is a grid structure having struts, wherein the one or more conducting areas and the one or more dissipation areas are connected together to form the grid structure, wherein the struts are spaced to form openings in the grid structure, wherein the openings between the struts are determined as a function of an amount of desired heat dissipation for the one or more LEDs, wherein the openings allow for gas flow from outside of the LED light bulb to enter the grid structure to cool the LEDs, wherein the cover covers the first side of the lighting structure, wherein the openings allow for transportation of heat from the first side of the lighting structure to the second side of the lighting structure, wherein the driver board having a positive terminal and a negative terminal for receiving electrical power, and the driver board connects to the lighting structure to power the LEDs thereon; and wherein the lighting structure has:

certain ones of the struts are disposed in a first direction; and other ones of the struts are disposed in a second direction, wherein the certain ones of the struts intersect the other ones of the struts, and wherein the LEDs are disposed at the intersections of the certain ones of the struts and the other ones of the struts; and, wherein the driver board is inserted into a holder for holding the driver board and the lighting structure; and, wherein the holder has a screw shape on one end for fitting into a light bulb socket.

7. The LED light bulb of claim 6 wherein the driver board is also a circuit board.

8. The LED light bulb of claim 6 wherein the driver board is in a Y shape.

9. The LED light bulb of claim 8 wherein the Y shape of the driver board has two prongs for connecting to the lighting structure.

10. The LED light bulb of claim 6 wherein the lighting structure is comprised of the copper frame encapsulated in a selected packaging type, wherein the copper frame is rigid, and wherein a reflective substance is disposed on the selected packaging type to reflect light from the LEDs.

11. A LED light bulb, comprising:

a driver board having a plurality of contact points to connect the driver board to a power source;

a conductive spring, wherein a first one of the contact points is coupled to the conductive spring;

a conductive hook, wherein a second one of the contact points is coupled to the conductive hook;

a lighting structure comprises a copper frame, wherein the lighting structure has one or more LEDs disposed thereon, wherein the lighting structure has a first side and a second side, wherein the LEDs are disposed on the first side of the lighting structure, wherein the copper frame has one or more conducting areas for conducting electricity to the LEDs and one or more dissipation areas for dissipating heat from the LEDs, and wherein the dissipation areas are not electrically connected to the conducting areas; and a cover, wherein the lighting structure is a grid structure having struts, wherein the one or more conducting areas and the one or more dissipation areas are connected together to form the grid structure, wherein the struts are spaced to form openings in the grid structure, wherein the openings between the struts are determined as a function of an amount of desired heat dissipation for the one or more LEDs, wherein the openings allow for gas flow from outside of the LED light bulb to enter the grid structure to cool the LEDs, wherein the cover covers the first side of the lighting structure, wherein the openings allow for transportation of heat from the first side of the lighting structure to the second side of the lighting structure, wherein the driver board having a positive terminal and a negative terminal for receiving electrical power, and the driver board connects to the lighting structure to power the LEDs thereon, wherein the lighting structure has:

certain ones of the struts are disposed in a first direction; and other ones of the struts are disposed in a second direction, wherein the certain ones of the struts intersect the other ones of the struts, wherein the driver board is also a circuit board, wherein the driver board is in a Y shape, wherein the Y shape of the driver board has two prongs for connecting to the lighting structure, and wherein the LEDs are disposed at the intersections of the certain ones of the struts and the other ones of the struts; and, wherein the driver board is inserted into a holder for holding the driver board and the lighting structure; and, wherein the holder has a screw shape on one end for fitting into a light bulb socket.

12. The LED light bulb of claim 11 wherein the lighting structure is comprised of the copper frame encapsulated in a selected packaging type wherein the copper frame is rigid, and wherein a reflective substance is disposed on the selected packaging type to reflect light from the LEDs.

* * * * *